US010467972B2

(12) United States Patent
Kim

(10) Patent No.: US 10,467,972 B2
(45) Date of Patent: Nov. 5, 2019

(54) DISPLAY DEVICE CONTROLLING A LEVEL OF A DATA SIGNAL

(71) Applicant: SAMSUNG DISPLAY CO., LTD., Yongin-si, Gyeonggi-do (KR)

(72) Inventor: Keunwoo Kim, Seongnam-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 966 days.

(21) Appl. No.: 14/996,250

(22) Filed: Jan. 15, 2016

(65) Prior Publication Data

US 2016/0365048 A1 Dec. 15, 2016

(30) Foreign Application Priority Data

Jun. 11, 2015 (KR) ..... 10-2015-0082707

(51) Int. Cl.
*G09G 5/00* (2006.01)
*G09G 3/36* (2006.01)

(52) U.S. Cl.
CPC ..... *G09G 3/3614* (2013.01); *G09G 3/3688* (2013.01); *G09G 3/3696* (2013.01); *G09G 2300/0426* (2013.01); *G09G 2320/0209* (2013.01); *G09G 2320/0219* (2013.01)

(58) Field of Classification Search
CPC .. G09G 3/3614; G09G 3/3688; G09G 3/3696; G09G 3/36; G09G 2300/0426; G09G 2320/0209; G09G 2320/0219
See application file for complete search history.

(56) References Cited

U.S. PATENT DOCUMENTS 7,202,606 B2 * 4/2007 Eom ..... G09G 3/3233 315/169.3
9,086,601 B2 * 7/2015 Jeong ..... G02F 1/134309
9,390,648 B2 * 7/2016 Lee ..... G09G 3/3233
9,746,723 B2 * 8/2017 Yang ..... G02F 1/1368
(Continued)

FOREIGN PATENT DOCUMENTS

KR 10-2010-0007077 A 1/2010
KR 10-2016-0092115 A 8/2016

OTHER PUBLICATIONS

Huang, et al., "Additional Refresh Technology (ART) of Advanced-MVA (AMVA) Mode for High Quality LCDs" (2007) pp. 1010-1013.

*Primary Examiner* — Vijay Shankar
(74) *Attorney, Agent, or Firm* — Kile Park Reed & Houtteman PLLC

(57) ABSTRACT

A display device includes a data driver connected to j- and (j+1)-th data lines, a scan driver connected to i- and (i+1)-th scan lines, and a display panel including k- and (k+1)-th pixel units. The k-th pixel unit includes an i-th transistor with a gate electrode connected to the i-th scan line, a first electrode connected to the j-th data line, and a second electrode connected to an i-th pixel electrode. The (k+1)-th pixel unit includes an (i+1)-th transistor having a gate electrode connected to the (i+1)-th scan line, a first electrode connected to the j-th data line, and a second electrode connected to an (i+1)-th pixel electrode. The i- and (i+1)-th transistors are turned on at a same time, and a kickback voltage of the i-th transistor is less than a kickback voltage of the (i+1)-th transistor.

20 Claims, 14 Drawing Sheets

(56) References Cited

U.S. PATENT DOCUMENTS

| | | | | |
|---|---|---|---|---|
| 2005/0243037 | A1* | 11/2005 | Eom | G09G 3/3233 345/76 |
| 2014/0062982 | A1* | 3/2014 | Lee | G09G 3/3233 345/211 |
| 2016/0216570 | A1 | 7/2016 | Yang et al. | |

* cited by examiner

【FIG 1】
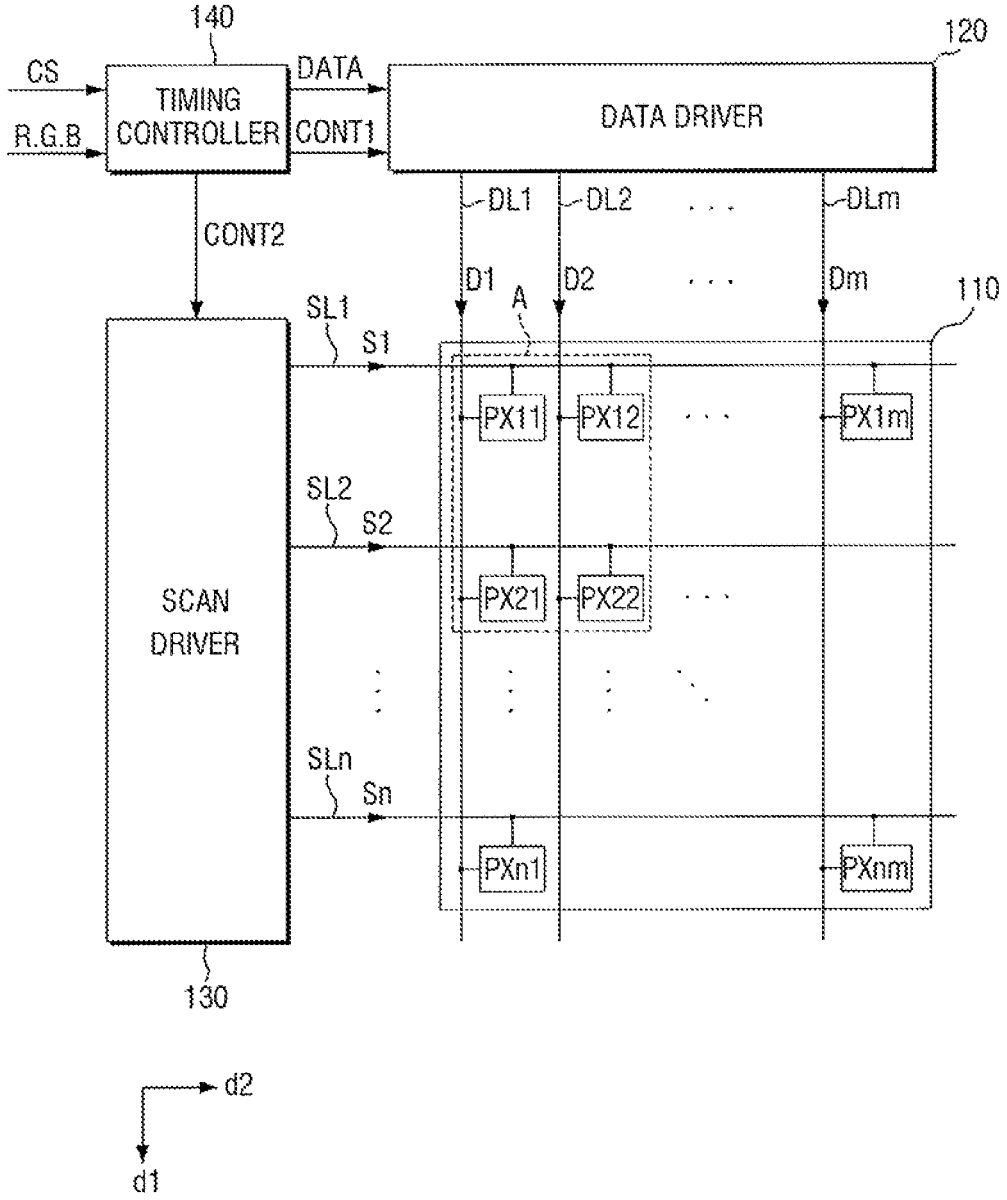

【FIG 2】
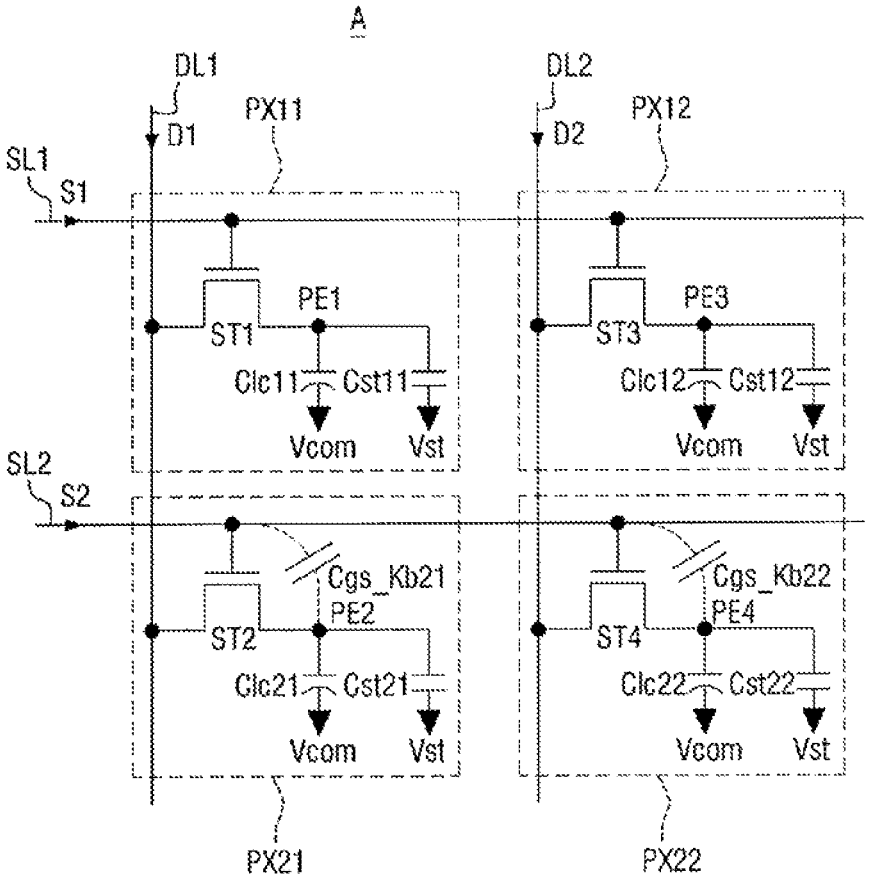

【FIG 3】
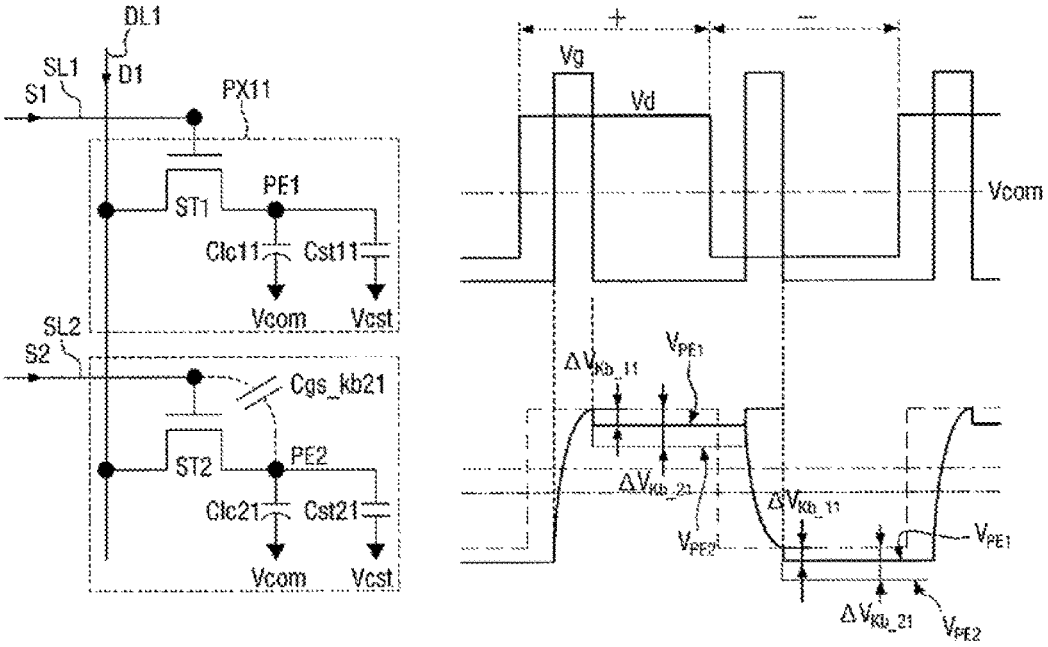

【FIG 4】
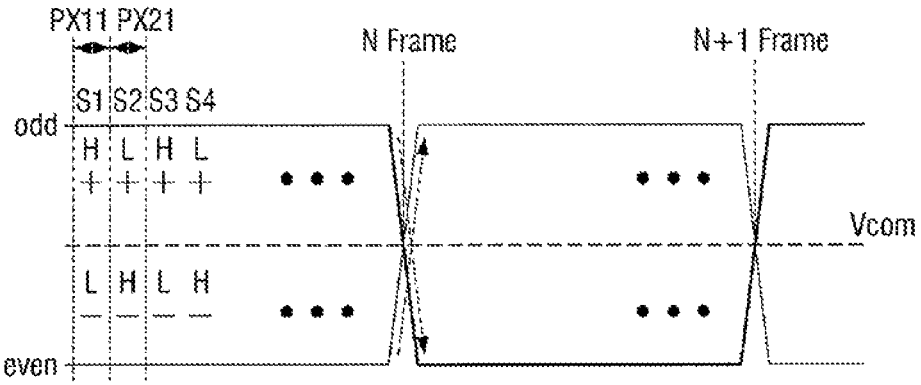

【FIG 5】
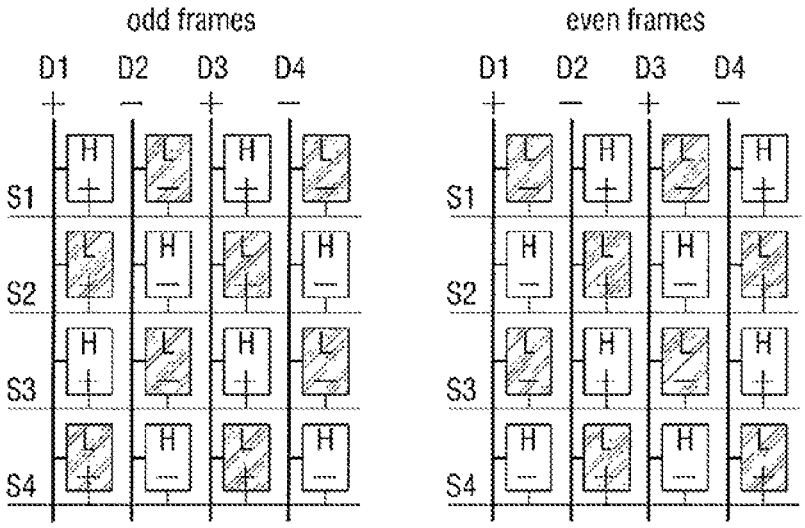

【FIG 6】
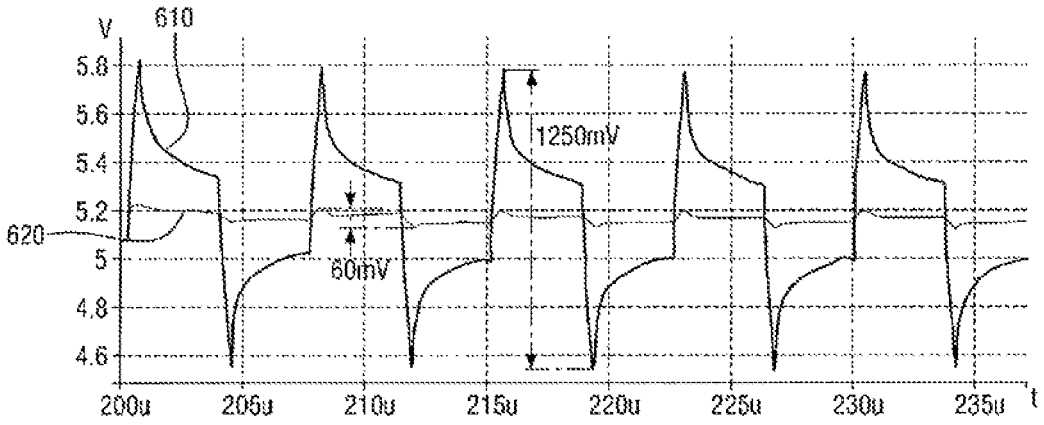

【FIG 7】
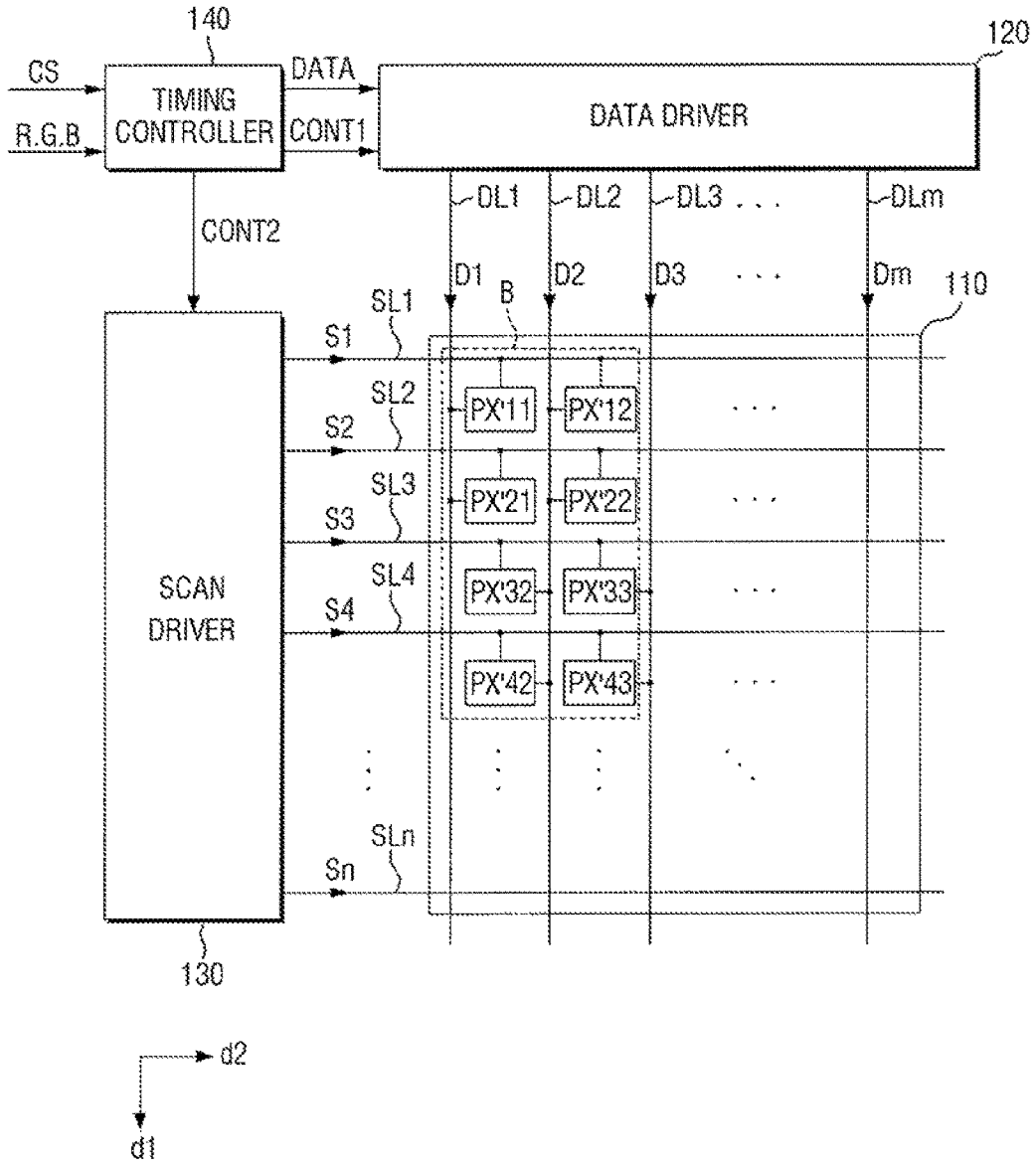

【FIG 8】
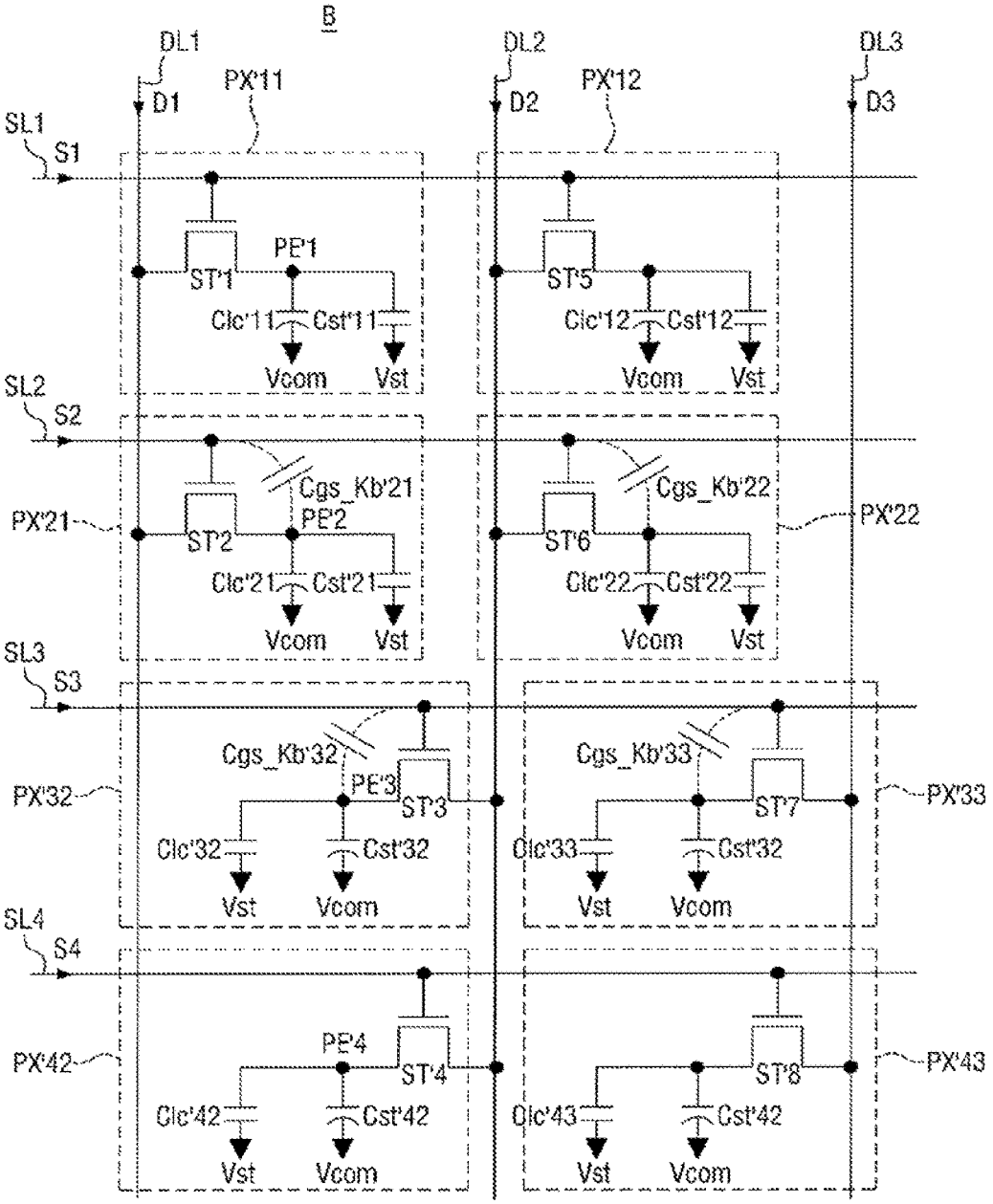

【FIG 9】
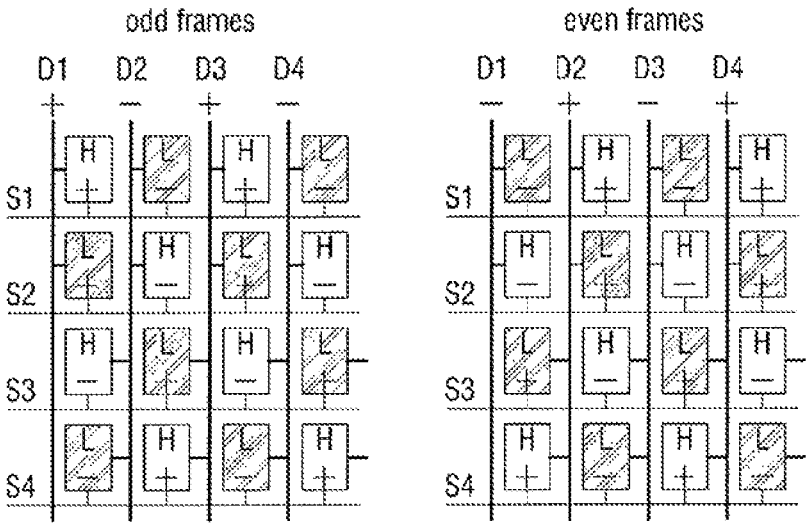

【FIG 10】
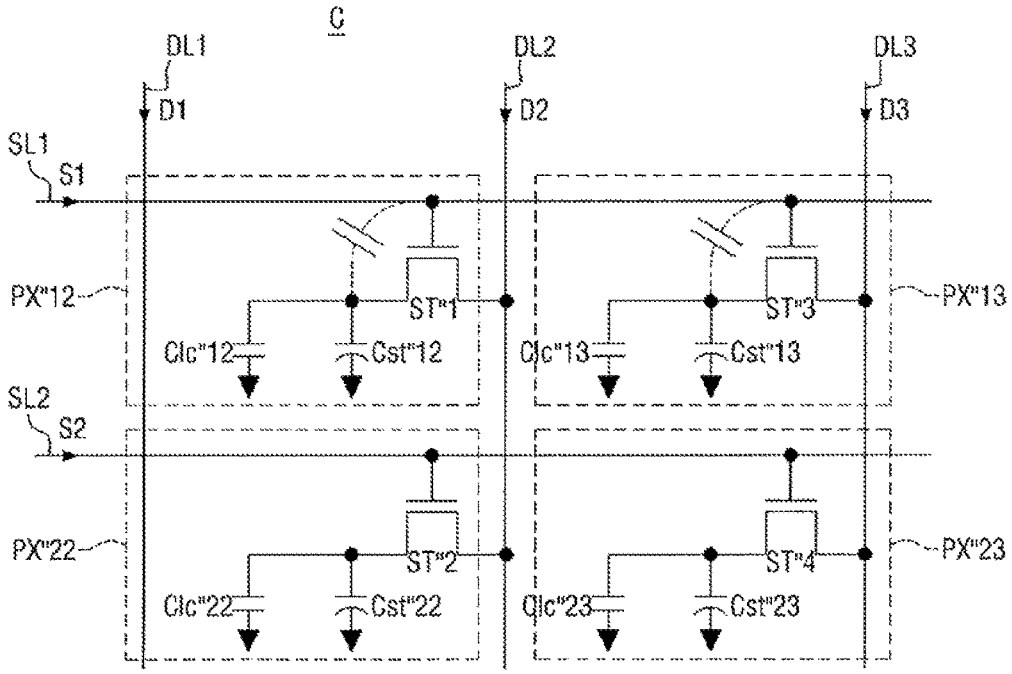

【FIG 11】
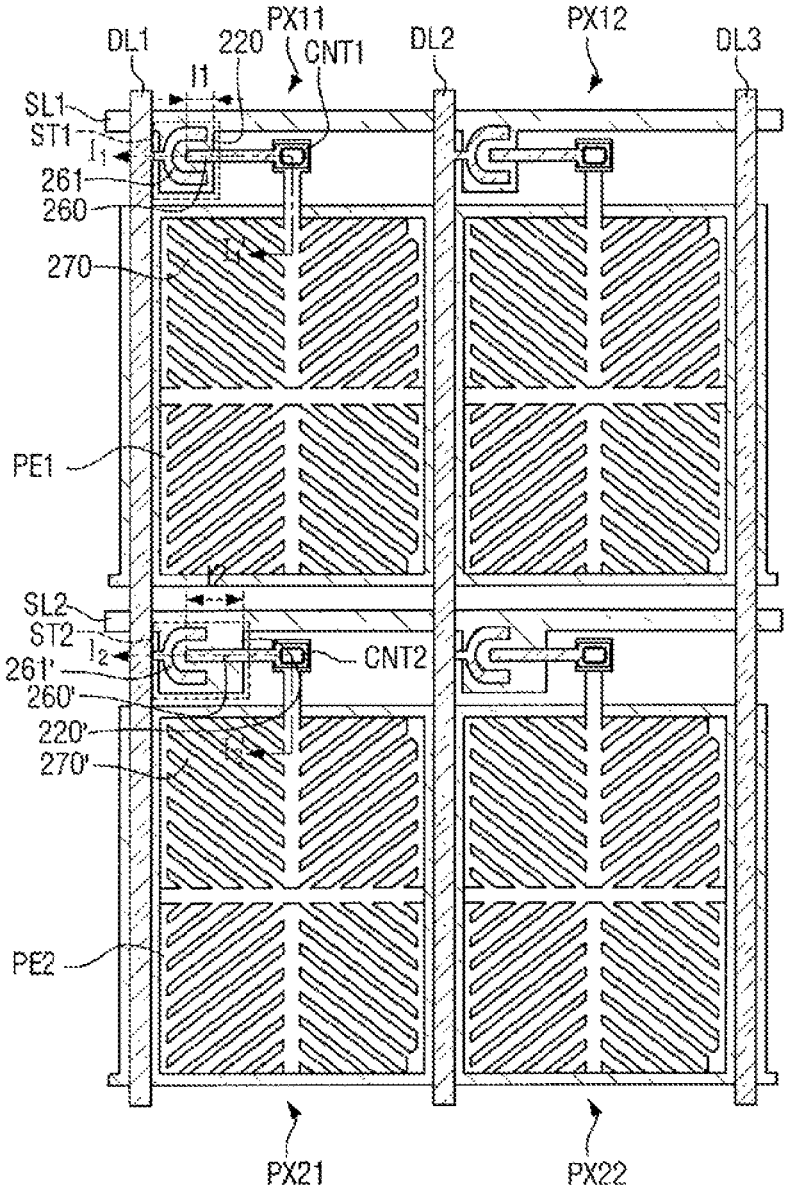

【FIG 12】
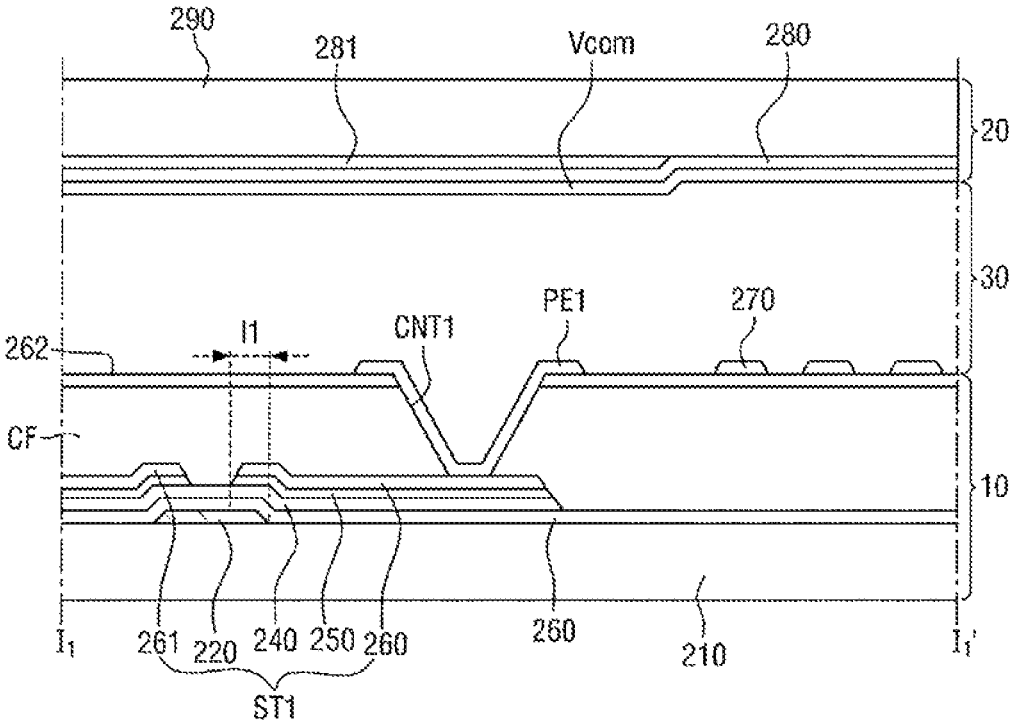

【FIG 13】
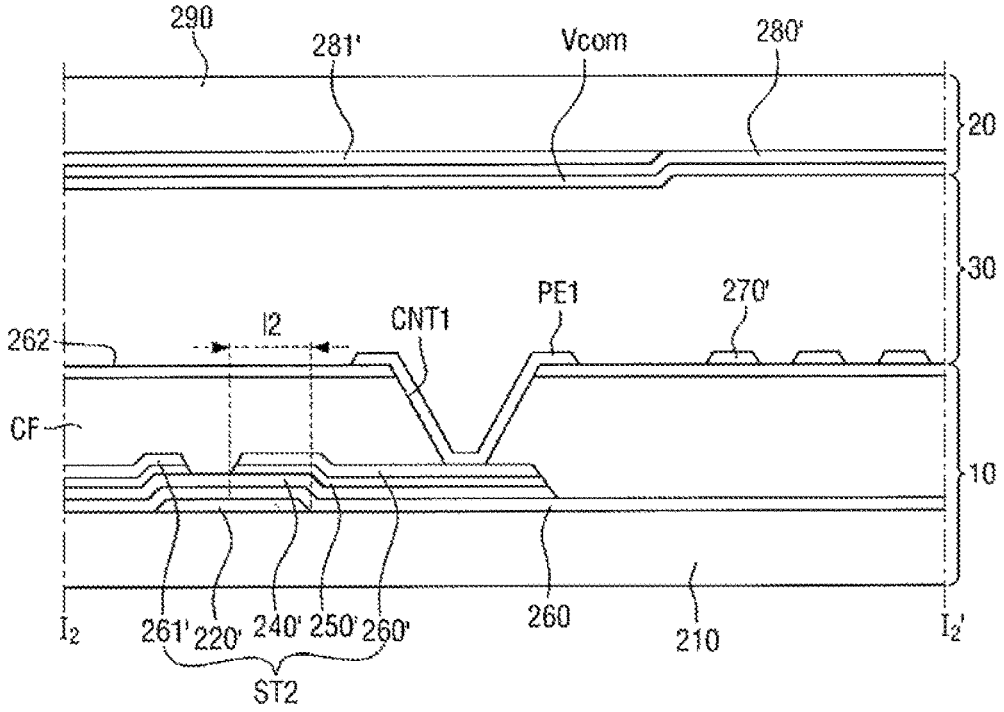

【FIG 14】
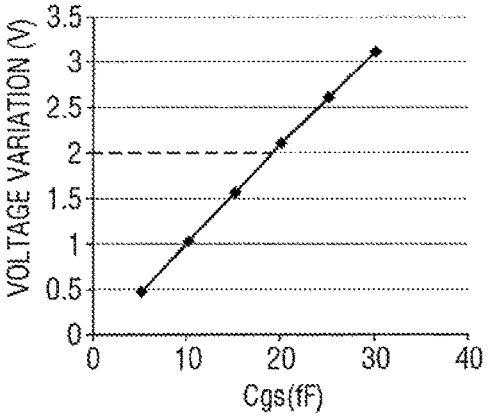
| OVERLAPPING AREA (um) | Cgs (fF) | PIXEL ELECTRODE (ΔV) |
|---|---|---|
| 10 | 5 | 0.47 |
| 20 | 10 | 1.04 |
| 30 | 15 | 1.58 |
| 40 | 20 | 2.11 |
| 50 | 25 | 2.61 |
| 60 | 30 | 3.1 |

DISPLAY DEVICE CONTROLLING A LEVEL OF A DATA SIGNAL

CROSS-REFERENCE TO RELATED APPLICATION

Korean Patent Application No. 10-2015-0082707, filed on Jun. 11, 2015, and entitled "Display Device," is incorporated by reference herein in its entirety.

BACKGROUND

1. Field

One or more embodiments described herein relate to a display device.

2. Description of the Related Art

The importance of display devices has steadily grown with recent developments in multimedia technology. As a result, a variety of display devices have been developed. Examples include liquid crystal displays (LCDs) and organic light-emitting diode (OLED) displays.

An LCD includes a liquid crystal layer between substrates that respectively include pixel electrodes and a common electrode. In operation, a voltage is applied to the electrodes to generate an electric field that controls the orientation of liquid crystal molecules in the liquid crystal layer and also the polarization of incident light. An image is displayed as a result. In a vertical alignment (VA)-mode LCD, the major axes of liquid crystal molecules are aligned to be perpendicular to a substrate when the electric field is not generated. Various attempts have been made to improve the side visibility of these displays.

SUMMARY

In accordance with one or more embodiments, a display device includes a data driver connected to j- and (j+1)-th data lines; a scan driver connected to i- and (i+1)-th scan lines; and a display panel including k- and (k+1)-th pixel units, wherein: the k-th pixel unit includes an i-th transistor with a gate electrode connected to the i-th scan line, a first electrode connected to the j-th data line, and a second electrode connected to an i-th pixel electrode, the (k+1)-th pixel unit includes an (i+1)-th transistor having a gate electrode connected to the (i+1)-th scan line, a first electrode connected to the j-th data line, and a second electrode connected to an (i+1)-th pixel electrode, the i- and (i+1)-th transistors are to be turned on at a same time, and a kickback voltage of the i-th transistor is less than a kickback voltage of the (i+1)-th transistor.

An overlapping area of the gate electrode and the second electrode of the i-th transistor may be less than an overlapping area of the gate electrode and the second electrode of the (i+1)-th transistor. A j-th data signal to be applied to the j-th data line may swing between a signal with positive polarity and having a higher level than a common voltage and a signal with negative polarity and having a lower level than a common voltage.

When a j-th data signal with positive polarity is applied to the j-th data line, a voltage applied to the i-th pixel electrode may be higher than a voltage applied to the (i+1)-th pixel electrode, and when a j-th data signal with negative polarity is applied to the j-th data line, a voltage applied to the i-th pixel electrode may be less than a voltage applied to the (i+1)-th pixel electrode. In at least one embodiment, j- and (j+1)-th data signals applied to the j- and (j+1)-th data lines, respectively, may swing between a voltage with positive polarity and a voltage with negative polarity relative to a common voltage and have opposite phases.

The display panel may include (k+2)- and (k+3)-th pixel units, the (k+2)-th pixel unit may include an (i+2)-th transistor having a gate electrode connected to the i-th scan line, a first electrode connected to the (j+1)-th data line, and a second electrode connected to an (i+2)-th pixel electrode, the (k+3)-th pixel unit may include an (i+3)-th transistor having a gate electrode connected to the (i+1)-th scan line, a first electrode connected to the (j+1)-th data line, and a second electrode connected to an (i+3)-th pixel electrode, and when a (j+1)-th data signal is applied to the first electrode of the (i+2)-th transistor from the (j+1)-th data line having a same level as a (j+1)-th data signal applied to the first electrode of the (i+3)-th transistor from the (j+1)-th data line, a kickback voltage of the (i+2)-th transistor is less than a kickback voltage of the (i+3)-th transistor.

When a j-th data signal with positive polarity is applied to the j-th data line and a (j+1)-th data signal with negative polarity is applied to the (j+1)-th data line, a voltage applied to the i-th pixel electrode may be greater than a voltage applied to the (i+1)-th pixel electrode, and a voltage applied to the (i+3)-th pixel electrode may be greater than a voltage applied to the (i+2)-th pixel electrode.

When a j-th data signal with negative polarity is applied to the j-th data line and a (j+1)-th data signal with positive polarity is applied to the (j+1)-th data line, a voltage applied to the i-th pixel electrode may be less than a voltage applied to the (i+1)-th pixel electrode, and a voltage applied to the (i+3)-th pixel electrode may be less than a voltage applied to the (i+2)-th pixel electrode.

In accordance with one or more other embodiments, a display device includes data driver connected to j- to (j+2)-th data lines; a scan driver connected to i- to (i+3)-th scan lines; and a display panel including k- and (k+1)-th pixel groups, wherein: the k-th pixel group includes an i-th transistor having a gate electrode connected to the i-th scan line, a first electrode connected to the j-th data line, and a second electrode connected to an i-th pixel electrode, and an (i+1)-th transistor having a gate electrode connected to the (i+1)-th scan line, a first electrode connected to the j-th data line, and a second electrode connected to an (i+1)-th pixel electrode, the (k+1)-th pixel group includes an (i+2)-th transistor having a gate electrode connected to the (i+2)-th scan line, a first electrode connected to the (j+1)-th data line, and a second electrode connected to an (i+2)-th pixel electrode, and an (i+3)-th transistor having a gate electrode connected to the (i+3)-th scan line, a first electrode connected to the (j+1)-th data line, and a second electrode connected to an (i+3)-th pixel electrode, the i- and (i+1)-th transistors are to be turned on at a same time, a kickback voltage of the i-th transistor is less than a kickback voltage of the (i+1)-th transistor, the (i+2)- and (i+3)-th transistors are to be turned on at the same time, and a kickback voltage of the (i+2)-th transistor is less than a kickback voltage of the (i+3)-th transistor.

An overlapping area of the gate electrode and the second electrode of the i-th transistor may be less than an overlapping area of the gate electrode and the second electrode of the (i+1)-th transistor, and an overlapping area of the gate electrode and the second electrode of the (i+2)-th transistor may be less than an overlapping area of the gate electrode and the second electrode of the (i+3)-th transistor.

In at least one embodiment, j- and (j+1)-th data signals applied to the j- and (j+1)-th data lines, respectively, may swing between a signal with positive polarity and having a greater level than a common voltage and a signal with negative polarity and having a lower level than a common voltage, and have opposite phases.

When a j-th data signal with positive polarity is applied to the j-th data line and a (j+1)-th data signal with negative polarity is applied to the (j+1)-th data line, a voltage applied to the i-th pixel electrode may be greater than a voltage applied to the (i+1)-th pixel electrode, and a voltage applied to the (i+2)-th pixel electrode is greater than a voltage applied to the (i+3)-th pixel electrode, and when a j-th data signal with negative polarity is applied to the j-th data line and a (j+1)-th data signal with positive polarity being applied to the (j+1)-th data line, a voltage applied to the i-th pixel electrode may be less than a voltage applied to the (i+1)-th pixel electrode, and a voltage applied to the (i+2)-th pixel electrode is less than a voltage applied to the (i+3)-th pixel electrode.

The k-th pixel group may include a (i+4)-th transistor having a gate electrode connected to the i-th scan line, a first electrode connected to the (j+1)-th data line, and a second electrode connected to an (i+4)-th pixel electrode, and an (i+5)-th transistor having a gate electrode connected to the (i+1)-th scan line, a first electrode connected to the (j+1)-th data line, and a second electrode connected to an (i+5)-th pixel electrode, and the (k+1)-th pixel group may include an (i+6)-th transistor having a gate electrode connected to the (i+2)-th scan line, a first electrode connected to the (j+2)-th data line, and a second electrode connected to an (i+6)-th pixel electrode, and an (i+7)-th transistor having a gate electrode connected to the (i+3)-th scan line, a first electrode connected to the (j+2)-th data line, and a second electrode connected to an (i+7)-th pixel electrode. A kickback voltage of the (i+4)-th transistor may be less than a kickback voltage of the (i+5)-th transistor, and a kickback voltage of the (i+6)-th transistor may be greater than a kickback voltage of the (i+7)-th transistor.

In accordance with one or more other embodiments, a display device includes first and second scan lines extending on a substrate in a first direction and connected to a scan driver; a first data line on the substrate along a second direction intersecting the first direction and insulated from the first and second scan lines; a first pixel unit including a first transistor having a gate electrode connected to the first scan line, a first electrode connected to the first data line, and a second electrode connected to a first pixel electrode; and a second pixel unit including a second transistor having a gate electrode connected to the second scan line, a first electrode connected to the first data line, and a second electrode connected to a second pixel electrode, wherein an overlapping area of the gate electrode and the second electrode of the second transistor is greater than an overlapping area of the gate electrode and the second electrode of the first transistor. An overlapping length of the gate electrode and the second electrode of the second transistor may be about 35 μm to about 60 μm longer than an overlapping length of the gate electrode and the second electrode of the first transistor. The first and second transistors may be turned on at a same time.

The display device may include a second data line on the substrate along the second direction; a third pixel unit including a third transistor having a gate electrode connected to the first scan line, a first electrode connected to the second data line, and a second electrode connected to a third pixel electrode; and a fourth pixel unit including a fourth transistor having a gate electrode connected to the second scan line, a first electrode connected to the second data line, and a second electrode connected to a fourth pixel electrode, wherein an overlapping area of the gate electrode and the second electrode of the fourth transistor is greater than an overlapping area of the gate electrode and the second electrode of the third transistor.

First and second data signals applied to the first and second data lines, respectively, may swing between a signal with positive polarity and having a higher level than a common voltage and a signal with negative polarity and having a lower level than a common voltage, and have opposite phases.

The display device may include third and fourth scan lines on the substrate along the first direction; a second data line on the substrate along the second direction; a third pixel unit including a third transistor having a gate electrode connected to the third scan line, a first electrode connected to the second data line, and a second electrode connected to a third pixel electrode; and a fourth pixel unit including a fourth transistor having a gate electrode connected to the fourth scan line, a first electrode connected to the second data line, and a second electrode connected to a fourth pixel electrode, wherein an overlapping area of the gate electrode and the second electrode of the third transistor is greater than an overlapping area of the gate electrode and the second electrode of the fourth transistor.

BRIEF DESCRIPTION OF THE DRAWINGS

Features will become apparent to those of skill in the art by describing in detail exemplary embodiments with reference to the attached drawings in which:

FIG. 1 illustrates an embodiment of a display device;

FIG. 2 illustrates an example of area A in FIG. 1;

FIGS. 3 to 5 illustrate examples of the operation of the display device;

FIG. 6 illustrates an example of ripples in a common voltage;

FIG. 7 illustrates another embodiment of a display device;

FIG. 8 illustrates an example of area B in FIG. 7;

FIG. 9 illustrates an example of the operation of the display device in FIG. 7;

FIG. 10 illustrates another example of area A in FIG. 1;

FIG. 11 illustrates an example of a plan view of area A in FIG. 1;

FIG. 12 illustrates a view along section line $I_1$-$I_1$' in FIG. 11;

FIG. 13 illustrates a view along section line $I_2$-$I_2$' in FIG. 11; and FIG. 14 illustrates an example of parasitic capacitances in the display device of FIG. 1.

DETAILED DESCRIPTION

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present between the element and the another element. In contrast, when an element is referred to as being "directly on", "directly connected to" or "directly coupled to" another element or layer, there are no intervening elements or layers present between the element and the another element. As used herein, the term "and/or" includes any and all combinations of one or more of the associated listed items.

FIG. 1 illustrates an embodiment of a display device which includes a display panel 110, a data driver 120, a scan driver 130 and a timing controller 140. The display panel 110 includes a lower display panel 10, an upper display panel 20 which faces the lower display panel 10, and a liquid crystal layer 30 between the lower display panel 10 and the upper display panel 20 (see, e.g., FIG. 12). The display panel 110 may be a liquid crystal panel including and/or connected to a plurality of scan lines SL1 to SLn and a plurality of data lines DL1 to DLm. The display panel 110 includes a plurality of pixel units PX11 to PXnm connected to the scan lines SL1 to SLn and data lines DL1 to DLm. The scan lines SL1 to SLn, data lines DL1 to DLm, and the pixel units PX11 to PXnm may be formed on the lower display panel 10, and the scan lines SL1 to SLn and data lines DL1 to DLm may be arranged to be insulated from each other.

The pixel units PX11 to PXnm may be arranged in a matrix. The data lines DL1 to DLm may extend on the lower display panel along a first direction d1. The scan lines SL1 to SLn may extend along a second direction d2 intersecting the first direction $d_1$. The first direction d1 may be a column direction, and the second direction d2 may be a row direction. Each of the pixel units PX11 to PXnm may be provided with a data voltage by a respective one of the data lines DL1 to DLm in response to a scan signal provided from a respective one of the scan lines SL1 to SLn.

Each of the pixels PX11 to PXnm may be connected to a plurality of lines (sustain voltage lines), which provide a voltage (sustain voltage) that is applied in common to the pixel units PX11 to PXnm. Accordingly, the pixel units PX11 to PXnm receive the sustain voltage from the sustain voltage lines.

The data driver 120 may include, for example, a shift register, a latch and a digital-to-analog converter (DAC). The data driver 120 receives a first control signal CONT1 and image data DATA from the timing controller 140. The data driver 120 may select a reference voltage according to the first control signal CONT1, and may convert the image data DATA, which has a digital waveform, into a plurality of data voltages D1 to Dm according to the selected reference voltage. The data driver 120 provides the data voltages D1 to Dm to the display panel 110.

The scan driver 130 receives a second control signal CONT2 from the timing controller 140, and provides scan signals S1 to Sn according to the second control signal CONT2.

The timing controller 140 receives an image signal R.G.B and a control signal CS for controlling the image signal R.G.B from an external source. The control signal CS may include, for example, a vertical synchronization signal Vsync, a horizontal synchronization signal Hsync, a main clock signal MCLK, and a data enable signal DE. The timing controller 140 processes the signals from the external source to be suitable for the operating conditions of the display panel 110 and generates the image data DATA, the first control signal CONT1 and a second control signal CONT2. The first control signal CONT1 may include a horizontal synchronization start signal STH indicating the start of the input of the image data DATA, and a load signal TP for controlling the application of the data voltages DL1 through DLm to the data lines DL1 through DLm. The second control signal CONT2 may include a scan initiation start signal STV for instructing the start of the output of the scan signals S1 through Sn and a gate clock signal CPV for controlling when to output a scan-on pulse.

The display device may also include a power supply. The power supply provides operating power for the display device and a common voltage Vcom to the display panel 110 via a common line. The common line apply the common voltage Vcom, which is provided by the power supply, to a common electrode of the display panel 110. The common line may be arranged on one side of the display panel 110 and may extend along one direction. The common line may be formed on the lower display panel 10 or the upper display panel 20, and may be insulated from the scan lines SL1 through SLn. The common electrode may be integrally formed on the lower display panel 10 or the upper display panel 20. The common voltage and the common electrode may both be indicated by "Vcom".

FIG. 2 illustrates an example of area A in FIG. 1. In this example, first, second, third, and fourth pixel units PX11, PX21, PX12, and PX22 are connected to one of first or second scan lines SL1 and SL2 and one of first or second data lines DL1 or DL2.

Referring to FIG. 2, the first pixel unit PX11 includes a first transistor ST1, a first liquid crystal capacitor Clc11, and a first storage capacitor Cst11. The first transistor ST1 may have a gate electrode connected to the first scan line SL1, a first electrode connected to the first data line DL1, and a second electrode connected to the first liquid crystal capacitor Clc11. In an exemplary embodiment, the first electrode of the first transistor ST1 may be a drain electrode, and the second electrode of the first transistor ST1 may be a source electrode.

The first liquid crystal capacitor Clc11 may include a first pixel electrode PE1 connected to the second electrode of the first transistor ST and a common electrode Vcom facing the first pixel electrode PE1. The first transistor ST1 may be turned on by a first scan signal S1 from the first scan line SL1, and may provide a first data signal D1 from the first data line DL1 to the first electrode of the first liquid crystal capacitor Clc11, e.g., the first pixel electrode PE1.

The first pixel unit PX11 may also include the first storage capacitor Cst11 having a first terminal connected to the second electrode of the first transistor ST1 and a second terminal to which a sustain voltage Vst is applied via a sustain electrode. The sustain voltage Vst may have, for example, the same level as the common voltage Vcom. In another embodiment, Vst may be different from Vcom.

The second pixel unit PX21 includes a second transistor ST2, a second liquid crystal capacitor Clc21, and a second storage capacitor Cst21. The second transistor ST2 may have a gate electrode connected to the second scan line SL2, a first electrode connected to the second data line DL2, and a second electrode connected to the second liquid crystal capacitor Clc21. In an exemplary embodiment, the first electrode of the second transistor ST2 may be a drain electrode, and the second electrode of the second transistor ST2 may be a source electrode.

The second liquid crystal capacitor Clc21 may include a second pixel electrode PE2 connected to the second electrode of the second transistor ST2 and a common electrode Vcom facing the second pixel electrode PE2. The second transistor ST2 may be turned on by a second scan signal S2 from the second scan line SL2, and may provide the first data signal D1 from the first data line DL1 to the first electrode of the second liquid crystal capacitor Clc21, e.g., the second pixel electrode PE2. The first and second scan signals S1 and S2 have the same phase. Accordingly, the first and second transistors ST1 and ST2 may perform substantially the same switching operation.

The second pixel unit PX21 may include the second storage capacitor Cst21, having a first terminal connected to the second electrode of the second transistor ST2 and a second terminal to which the sustain voltage Vst is applied via a sustain electrode.

When the first and second transistors ST1 and ST2 are turned on at the same time, the first and second pixel units PX11 and PX21 may recite the same data voltage, e.g., the first data signal D1. In this case, a kickback voltage of the first transistor ST1 may be lower than a kickback voltage of the second transistor ST2, as described in greater detail with reference to FIGS. 3 to 5.

The third pixel unit PX12 is substantially the same as the first pixel unit PX11, except that the third pixel unit PX12 is connected to the second data line D2 rather than the first data line D1. The fourth pixel unit PX22 is substantially the same as the second pixel unit PX21, except that the fourth pixel unit PX22 is connected to the second data line D2 rather than the first data line D1.

FIGS. 3 to 5 illustrate an example of the operation of the display device in FIG. 1. FIG. 3 illustrates an example of voltages applied to the first and second pixel electrodes PE1 and P2 of the first and second pixel units PX11 and PX21 in part A of FIG. 1. FIGS. 4 and 5 illustrate a change in polarity of the first and second pixel units PX11 and PX21 according to the level of a data signal. In the description that follows, for illustrative purposes only, it is assumed that the first electrodes of the first and second transistors ST1 and ST2 are drain electrodes and the other electrodes of the first and second transistors ST1 and ST2 are source electrodes.

Referring to FIG. 3, when the first and second transistors ST1 and ST2 are turned on at the same time, the first and second pixel units PX11 and PX21 are provided with the same voltage, e.g., the first data signal D1. In this case, the kickback voltage of the first transistor ST1 may be lower than the kickback voltage of the second transistor ST2. The first data signal D1 may be a signal swinging between a positive voltage higher than the common voltage Vcom and a low voltage lower than the common voltage Vcom, as illustrated in FIG. 4. A data signal with positive polarity (+) may be a data signal with a higher voltage than the common voltage Vcom, and a data signal with negative polarity (−) may be a data signal with a lower voltage than the common voltage Vcom. (Any voltage variations caused by the resistance of data wiring or parasitic components are not considered.)

The overlapping area of the gate and source electrodes of the first transistor ST1 may be less than the overlapping area of the gate and source electrodes of the second transistor ST2. Accordingly, parasitic capacitance between the gate and source electrodes of the first transistor ST1 may be less than parasitic capacitance generated between the gate and source electrodes of the second transistor ST2.

Accordingly, in response to the first data signal D1 being a data signal with positive polarity (+), the level of the first signal D1 applied to the first pixel electrode PE1 of the first pixel unit PX11 may be higher than the level of the first data signal D1 applied to the second pixel electrode PE2 of the second pixel unit PX21. This is because the kickback voltage of the first transistor ST1 is lower than the kickback voltage of the second transistor ST2. In this case, referring to FIGS. 3 and 5, the first pixel unit PX11 may become a high pixel unit H due to the level of the voltage applied to the first pixel electrode PE1, and the second pixel unit PX21 may become a low pixel unit L due to the level of the voltage applied to the second pixel electrode PE2.

When the first data signal D1 is a data signal with negative polarity (−), the level of the first signal D1 applied to the first pixel electrode PE1 of the first pixel unit PX11 may be lower than the level of the first data signal D1 applied to the second pixel electrode PE2 of the second pixel unit PX21. This is because the kickback voltage of the first transistor ST1 is lower than the kickback voltage of the second transistor ST2. In this case, the first pixel unit PX11 may become a low pixel unit L, and the second pixel unit PX21 may become a high pixel unit L.

The kickback voltage may be understood to correspond to a variation in a voltage applied to a pixel electrode caused by the transition of a scan signal, e.g., from a high voltage to a low voltage. An example is described below.

The kickback voltage ΔVkb_1 generated by a parasitic capacitance component between the gate and source electrodes of the first transistor ST1 of the first pixel unit PX11 may be represented by Equation 1.

$$\Delta Vkb_1=(Cgs/(Cgs+Clc+Cst)*\Delta Vgs \quad (1)$$

where Cgs denotes the capacitance of the parasitic capacitance component between the gate and source electrodes of the first transistor ST1, Cgs denotes the capacitance of the liquid crystal capacitor Clc11 of the first pixel unit PX11, Cst denotes the capacitance of the storage capacitor Cst11 of the first pixel unit PX11, and ΔVgs indicates a difference between the gate and source voltages of the first scan signal S1.

The kickback voltage ΔVkb_2 generated by a parasitic capacitance component between the gate and source electrodes of the second transistor ST2 of the second pixel unit PX21 may be represented by Equation 2.

$$\Delta Vkb_2=(Cgs+Cgs_kb21/(Cgs+Cgs_kb21+Clc+Cst)*\Delta Vgs \quad (2)$$

Since the overlapping area of the gate and source electrodes of the second transistor ST2 of the second pixel unit PX21 is larger than the overlapping area of the gate and source electrodes of the first transistor ST1 of the first pixel unit PX11, the capacitance of the parasitic capacitance component between the gate and source electrodes of the second transistor ST2 may be larger than the capacitance of the parasitic capacitance component between the gate and source electrodes of the first transistor ST1. In Equation (2), Cgs_kb21 may indicate parasitic capacitance corresponding to an area obtained by subtracting the overlapping area of the gate and source electrodes of the first transistor ST1 from the overlapping area of the gate and source electrodes of the second transistor ST2.

Voltages $V_{PE1}$ and $V_{PE2}$ respectively applied to the first and second pixel electrodes PE1 and PE2 of the first and second pixel units PX11 and PX21 when the first data signal D1 is a data signal with positive polarity (+) may be represented by Equations 3.

$$V_{PE1}=(V\text{data}-Vkb_1)-V\text{com}$$

$$V_{PE2}=(V\text{data}-Vkb_2)-V\text{com} \quad (3)$$

where Vdata denotes the level of the first data signal D1 applied to the first and second pixel units PX11 and PX21.

As is apparent from Equations (3), when the first data signal D1 with positive polarity (+) is applied to both the first and second pixel units PX11 and PX21, the voltage $V_{PE1}$ applied to the first pixel electrode PE1 may be higher than the $V_{PE2}$ applied to the second pixel electrode PE2 due to the difference between the kickback voltages Vkb_1 and Vkb_2 of the first and second transistors ST1 and ST2. Thus, even if the first and second pixel units PX11 and PX21 are provided with the same first data signal D1 having positive polarity (+), the first data signal D1 applied to the first pixel unit PX11 may be maintained at a lower level than the first data signal D1 applied to the second pixel unit PX21 due to the difference between the kickback voltages Vkb_1 and Vkb_2 of the first and second transistors ST1 and ST2.

Voltages $V_{PE1}$ and $V_{PE2}$ respectively applied to the first and second pixel electrodes PE1 and PE2 of the first and second pixel units PX11 and PX21 when the first data signal D1 is a data signal with negative polarity (−) may be represented by Equations 4.

$$V_{PE1}=V\text{com}-(V\text{data}-Vkb_1)$$

$$V_{PE2}=V\text{com}-(V\text{data}-Vkb_2) \quad (4)$$

Unlike Equations 3, in the case of Equations 4, when the first data signal with negative polarity (−) is applied to the first and second pixel units PX11 and PX21, the voltage $V_{PE1}$ applied to the first pixel electrode PE1 may be lower than the $V_{PE2}$ applied to the second pixel electrode PE2. Thus, even if the first and second pixel units PX11 and PX21 are provided with the same first data signal D1 having negative polarity (−), the first data signal D1 applied to the second pixel unit PX21 may be maintained at a lower level than the first data signal D1 applied to the first pixel unit PX11 due to the difference between the kickback voltages Vkb_1 and Vkb_2 of the first and second transistors ST1 and ST2.

Thus, when a data signal having positive polarity (+) is applied, the first pixel unit PX11 may serve as a high pixel unit H in connection with the second pixel unit PX21. When a data signal having negative polarity (−) is applied, the second pixel unit PX21 may serve as a low pixel unit L in connection with the second pixel unit PX21. The second pixel unit PX21 may serve as a high pixel unit H when the first pixel unit PX11 serves as a low pixel unit L, and may serve as a low pixel unit L when the first pixel PX11 serves as a high pixel unit H.

Accordingly, the display device according to the exemplary embodiment of FIG. 1 may control the level of a data signal applied to each pixel unit without having to spatially divide each pixel unit into two sub-pixels with the use of an additional transistor for dividing a voltage.

FIGS. 4 and 5 illustrate examples of the operation of the display panel 110 including the first and second pixel units PX11 and PX21. When the first and second pixel units PX11 and PX21 are grouped together as a pixel group, a plurality of pixel groups may be arranged as illustrated in FIG. 5. The pixel units in each of the pixel groups may respectively serve as a high pixel unit L and a low pixel unit L depending on the polarity of the applied data signal. The pixel units in each of the pixel groups may be provided with scan signals having the same phase, and thus may perform the same transistor switching operation. Thus, the transistors of the pixel units in each of the pixel groups may be turned on or off at the same time.

In an exemplary embodiment, a pixel unit connected to an odd-numbered data line DL2*k*−1 (k not smaller than 1), which is one of the data lines DL1 to DLm, may receive a data signal with positive polarity (+) during an N-th frame and may receive a data signal with negative polarity (−) during an (N+1)-th frame. On the other hand, a pixel unit connected to an even-numbered data line DL2*k* (k not smaller than 1), which is another one of the data lines DL1 through DLm, may receive a data signal with negative polarity (−) during the N-th frame and may receive a data signal with positive polarity (+) during the (N+1)-th frame. In this exemplary embodiment, when the transistors of these two pixel units are provided with data signals with the same voltage, one of the pixel units that has a relatively low kickback voltage may serve as a high pixel unit H. The other pixel unit that has a relatively high kickback voltage may serve as a low pixel unit L.

In another embodiment, the pixel unit connected to the odd-numbered data line DL2*k*−1 may receive a data signal with negative polarity (−) during the N-th frame and may receive a data signal with positive polarity (+) during the (N−1)-th frame.

FIG. 6 illustrates an example of ripples in a common voltage of the display device of FIG. 1. Referring to FIG. 6, reference numeral 610 represents ripples in the common voltage of a related-art display device, and reference numeral 620 represents ripples in the common voltage Vcom of the display device of FIG. 1.

The common voltage of the related-art display device has a variation of up to 1250 mV, but the common voltage Vcom of the display device according to FIG. 1 has a variation of up to 60 mV, which about 20 times less than the related-art display device. This may result because, in the display device of FIG. 1, a pixel unit connected to the odd-numbered data line DL2*k*−1 receives a data signal with positive polarity (+) during the N-th frame and receives a data signal with negative polarity (−) during the (N+1)-th frame (or vice versa). As a result, the ripples in the common voltage Vcom are offset.

For example, in the display device of FIG. 1, even if a plurality of pixel units are arranged in the display panel 110 as illustrated in FIG. 5, ripples in the common voltage Vcom may offset one another because the swing directions of data signals are opposite to one another. Accordingly, a crosstalk phenomenon may be improved.

FIG. 7 illustrates another embodiment of a display device, and FIG. 8 illustrates an example of a circuit diagram corresponding to area B in FIG. 7. FIG. 9 is a view illustrating the operation of the display device according to the exemplary embodiment of FIG. 7. The display device in FIG. 7 is substantially the same as the display device in FIG. 1, except for connections between some pixel units and data lines. In FIGS. 7 to 9, first, second, third, and fourth pixel units are indicated by reference numerals PX'11, PX'21, PX'12, and PX'22, respectively.

Referring to FIGS. 7 and 8, the display device may include first, second, third, fourth, fifth, sixth, seventh, and eighth pixel units PX'11, PX'21, PX'32, PX'22, PX'12, PX'22, PX'33, and PX'43, which are connected to one of first and second data lines DL1 and DL2 and one of first through fourth scan lines SL1 to SL4.

The first and second pixel units PX'11 and PX'21 are substantially the same as the first and second pixel units PX11 and PX21 in FIG. 2. The fifth and sixth pixel units PX'12 and PX'22 are substantially the same as the third and fourth pixel units PX12 and PX22 in FIG. 2.

The third pixel unit PX'32 may include a third transistor ST'3, a third liquid crystal capacitor Clc'32, and a third storage capacitor Cst'32. The third transistor ST'3 may have a gate electrode connected to the third scan line SL3, a first electrode connected to the second data line DL2, and a second electrode connected to the third liquid crystal capacitor Clc'32. In an exemplary embodiment, the first electrode of the third transistor ST'3 may be a drain electrode, and the second electrode of the third transistor ST'3 may be a source electrode. Unlike first and second transistors ST'1 and ST'2 of the first and second pixel units PX'11 and PX'21, the third transistor ST'3 may be connected to the second data line DL2. The third liquid crystal capacitor Clc'32 may include a third pixel electrode PE'3 connected to the second electrode of the third transistor ST'3 and a common electrode Vcom facing the third pixel electrode PE'3. The third pixel unit PX'32 may also include the third storage capacitor Cst'32.

The fourth pixel unit PX'42 may include a fourth transistor ST'4, a fourth liquid crystal capacitor Clc'42, and a fourth storage capacitor Cst'42. The fourth transistor ST'4 may have a gate electrode connected to the fourth scan line SL4, a first electrode connected to the second data line DL2, and a second electrode connected to the fourth liquid crystal capacitor Clc'42. In an exemplary embodiment, the first electrode of the third transistor ST'3 may be a drain electrode, and the second electrode of the third transistor ST'3 may be a source electrode. The fourth transistor ST'4 may be connected to the second data line DL2. The fourth liquid crystal capacitor Clc'42 may include a fourth pixel electrode PE'4 connected to the second electrode of the fourth transistor ST'4 and a common electrode Vcom facing the fourth pixel electrode PE'4. The fourth pixel unit PX'42 may also include the fourth storage capacitor Cst'42.

When the first and second transistors ST'1 and ST'2 of the first and second pixel units PX'11 and PX'21 are turned on at the same time, the first and second pixel units PX'11 and PX'21 may receive the same data voltage, e.g., a first data signal D1. In this case, the kickback voltage of the first transistor ST'1 may be lower than the kickback voltage of the second transistor ST'2.

On the other hand, when the third and fourth transistors ST'3 and ST'4 of the third and fourth pixel units PX'32 and PX'42 are turned on at the same time, the third and fourth transistors ST'3 and ST'4 may receive the same data voltage, e.g., a second data signal D2, which has an opposite polarity to the first data signal D1. In this case, the kickback voltage of the third transistor ST'3 may be higher than the kickback voltage of the fourth transistor ST'4.

The seventh and eighth pixel units PX'33 and PX'43 are substantially the same as the third and fourth pixel units PX'32 and PX'42, except that they are connected to the third data line D3 rather than the second data line D2.

Referring to FIGS. 8 and 9, the overlapping area of the gate and source electrodes of the first transistor ST'1 may be less than the overlapping area of the gate and source electrodes of the second transistor ST'2. Accordingly, parasitic capacitance between the gate and source electrodes of the first transistor ST'1 may be less than parasitic capacitance between the gate and source electrodes of second transistor ST'2.

On the other hand, the overlapping area of the gate and source electrodes of the third transistor ST'3 may be greater than the overlapping area of the gate and source electrodes of the fourth transistor ST'4. Accordingly, parasitic capacitance between the gate and source electrodes of the third transistor ST'3 may be greater than parasitic capacitance between the gate and source electrodes of the fourth transistor ST'4.

In response to the first data signal D11 having positive polarity (+) and the second data signal D2 having negative polarity (−), the level of the first signal D1 applied to the first pixel electrode PE'1 of the first pixel unit PX'11 may be greater than the level of the first data signal D1 applied to the second pixel electrode PE'2 of the second pixel unit PX'21. This is because the kickback voltage of the first transistor ST'1 is less than the kickback voltage of the second transistor ST'2. For example, referring to FIG. 8, the first pixel unit PX'1 may become a high pixel unit H due to the level of the voltage applied to the first pixel electrode PE'1. The second pixel unit PX'21 may become a low pixel unit L due to the level of the voltage applied to the second pixel electrode PE'2.

On the other hand, since the third pixel unit PX'32 is provided with the second data signal D2 having negative polarity (−) and the kickback voltage of the third transistor ST'3 is greater than the kickback voltage of the fourth transistor ST'4, the third pixel unit PX'32 may become a high pixel unit H and the fourth pixel unit PX'42 may become a low pixel unit L.

Alternatively, in response to the first data signal D1 having negative polarity (−) and the second data signal D2 having positive polarity (+), the first pixel unit PX'11 may become a low pixel unit L, the second pixel unit PX'21 may become a high pixel unit L, the third pixel unit PX'32 may become a low pixel unit L, and the fourth pixel unit PX'42 may become a high pixel unit H.

FIG. 10 is a circuit diagram illustrating another example of area A in FIG. 1, which will be referred to as area C. In FIG. 10, first, second, third, and fourth pixel units are indicated by reference numerals PX"12, PX"22, PX"13, and PX"23, respectively.

Referring to FIGS. 2 and 10, the first and second pixel units PX"12 and PX"22 in area C may be substantially the same as the second and first pixel units PX21 and PX11, respectively, in area A of FIG. 2, except that: the first pixel unit PX"12 differs from the second pixel unit PX21 in that a first transistor ST"1 is connected to a second data line DL2; and the second pixel unit PX"22 differs from the first pixel unit PX11 in that a second transistor ST"2 is connected to the second data line DL2.

The third and fourth pixel units PX"13 and PX"23 in area C may be substantially the same as the fourth and pixel units PX22 and PX12, respectively, in area A of FIG. 2, except that: the third pixel unit PX"13 differs from the fourth pixel unit PX22 in that a third transistor ST"3 is connected to a third data line DL3; and the fourth pixel unit PX"23 differs from the third pixel unit PX12 in area A in that a fourth transistor ST"4 is connected to the third data line DL3.

Accordingly, in a display device of FIG. 10, two pixel units with different kickback voltages may be provided with scan signals having the same phase. Thus, even when the two pixel units are provided with the same data signal, different voltages may be generated in the pixel electrodes of the two pixel units due to a difference between the kickback voltages of the two pixel units. Accordingly, the display device of FIG. 10 may control the level of a data signal applied to each pixel unit without requiring an additional transistor for dividing a voltage.

FIG. 1 is an example of a plan view of area A in FIG. 1, and FIG. 12 is a cross-sectional view taken line $I_1$-$I_1$' in FIG. 11. The first pixel unit PX11 will hereinafter be described first with reference to FIGS. 11 and 12.

Referring to FIGS. 11 and 12, the display device of FIG. 1 may include the liquid crystal layer 30 between the lower and upper display panels 10 and 20, which face each other. The lower display panel 10 may be bonded to the upper display panel 20, for example, through sealing. The lower display panel 10 will be described.

In an exemplary embodiment, a lower substrate 210 may be, for example, a glass substrate, a plastic substrate, or a low-temperature polysilicon (LTPS) substrate. The first and second scan lines SL1 and SL2, the first through third data lines DL1 through DL3 which are formed to be insulated from the first and second scan lines SL and SL2, and the first and second transistors ST1 and ST2 may be on the lower substrate 210. The first transistor ST1 may include a first gate electrode 220 which protrudes from the first scan line SL1. The first transistor ST1 may receive the first scan signal S1 from the first scan line SL1 through the first gate electrode 220.

A gate insulating layer 230 may be on the first gate electrode 220. In an exemplary embodiment, the gate insulating layer 230 may be formed, for example, of silicon nitride (SiNx) or silicon oxide (SiOx). The gate insulating layer 230 may have a multilayer structure including at least two insulating layers having different physical properties. A first semiconductor layer 240 may be on the gate insulating layer 230 and may include for example, amorphous silicon or crystalline silicon.

A resistive contact layer 250 may be on the first semiconductor layer 240 and may include, for example, a material such as n+ hydrogenated amorphous silicon which is doped with a high concentration of n-type impurities such as phosphorous (P) or silicide. In another embodiment, a pair of resistive contact layer 250 may be on the first semiconductor layer 240.

A first source electrode 260 corresponding to the first transistor ST1 may be paired with a first drain electrode 261, and may be disposed on the first semiconductor layer 240 with the first drain electrode 261. The first source electrode 260 may be on a first gate electrode 220 and may at least partially overlap the first gate electrode 220. The first source electrode 260 may be connected to the first pixel electrode PE1 on a second side thereof. In an exemplary embodiment, the first source electrode 260 may overlap the first gate electrode 220 by as much as a length l1.

The first source electrode 260 may be formed of a refractory metal, for example, such as molybdenum (Mo), chromium (Cr), tantalum (Ta), or titanium (Ti) or an alloy of the refractory metal. In one embodiment, the first source electrode 260 may have a multilayer structure including a refractory metal layer and a low-resistance conductive layer. The first source electrode 260 may be formed using various metals or conductors other than the examples mentioned herein.

The first drain electrode 261 may extend from the first data line DL1 and may surround at least part of the first source electrode 260. For example, the first drain electrode 261 may be formed in one of a C shape, a U shape, an inverse C shape, and inverse U shape, or another shape. The first drain electrode 261 may be formed of the same material as the first source electrode 260 and may have the same structure as the first source electrode 260. Thus, the first source electrode 260 and the first drain electrode 261 may be simultaneously formed by the same process.

The first gate electrode 220, the first source electrode 260, and the first drain electrode 261 may form the first transistor ST1 along with the first semiconductor layer 240. The channel of the first transistor ST1 may be formed in a semiconductor part between the first source electrode 260 and the first drain electrode 261.

A color filter CF and a protective layer 262 may be on the first source electrode 260 and the first drain electrode 261. The color filter CF may emit one of three primary colors, e.g., red (R), green (G), and blue (B). The color filter CF may be formed of a material capable of rendering different colors in a number of pixels that are adjacent to one another. The protective layer 262 may be formed of an inorganic insulating material such as SiNx or SiOx or an organic insulating material.

A first contact hole CNT1 exposes the first source electrode 260 and may be formed on the color filter CF and the protective layer 262. The first pixel electrode PE1 may be on the protective layer 262. The first pixel electrode PE1, for example, may be generally rectangular and may include a cross-shaped stem having a vertical stem intersecting a horizontal stem portion. The pixel electrode PE1 may be divided into a plurality of sub-areas by the horizontal and vertical stem portions, and may also include a plurality of fine branches 270 in the sub-areas.

An upper substrate 290 may be formed, for example, of transparent glass or a plastic material. A light-blocking member 281 (e.g., a black matrix) that prevents light leakage may be disposed on the upper substrate 290. An overcoat layer 280 may be on the upper substrate 290 and the light-blocking member 281. The overcoat layer 280 may be optionally included and formed of an insulating material.

A common electrode Vcom may be on the overcoat layer 280. The common electrode Vcom may generate an electric field with the first pixel electrode PE1, which is provided with the first data signal D1. The electric field determines the alignment direction of liquid crystal molecules in the liquid crystal layer 30.

FIG. 13 is an example of a cross-sectional view taken along section line $I_2$-$I_2$' in FIG. 11. More specifically, FIG. 13 illustrates a cross-sectional view of the second pixel unit PX21 taken along line $I_2$-$I_2$'.

Referring to FIGS. 11 and 13, the second transistor ST2 may include a second gate electrode 220', a second source electrode 260', and a second drain electrode 261'. The second source electrode 260 may overlap the second gate electrode 220' by as much as a length l2. In one embodiment, the length l1 by which the first gate electrode 220 and the first source electrode 260 of the first pixel unit PX11 overlap may be less than the length l2 by which the second gate electrode 220' and the second source electrode 260' of the second pixel unit PX21 overlap. As a result, the overlapping area of the first gate electrode 220 and the first source electrode 260 of the first pixel unit PX11 may be less than the overlapping area of the second gate electrode 220' and the second source electrode 260' of the second pixel unit PX21. Since the overlapping area of the first gate electrode 220 and the first source electrode 260 of the first transistor ST1 is less than the overlapping area of the second gate electrode 220' and the second source electrode 260' of the second transistor ST2, the kickback voltage of the second transistor ST2 may be greater than the kickback voltage of the first transistor ST1.

Accordingly, even when the first and second drain electrodes 261 and 261' of the first and second pixel units PX11 and PX21 are provided with the same data signal with a particular polarity and level, the voltages respectively applied to the first and second pixel electrodes PE1 and PE2 may differ from each other due to a difference in the kickback voltages of the first and second transistors ST1 and ST2. For example, when the first and second pixel units PX11 and PX21 are provided with a data signal with positive polarity (+), the voltage applied to the first pixel electrode PE1 of the first pixel unit PX11, which has a relatively low kickback voltage, may be greater than the voltage applied to the second pixel electrode PE2 of the second pixel unit PX21. Accordingly, the first pixel unit PX11 may serve as a high pixel unit H and the second pixel unit PX21 may serve as a low pixel unit L.

In another embodiment, the display device may have a different configuration provided a pair of adjacent pixel units receive the same data signal with a particular polarity and a particular level and have different kickback voltages.

FIG. 14 is a table illustrating an example of parasitic capacitances for different gate electrode-source electrode overlapping areas of transistors in the display device of FIG. 1. Referring to the table of FIG. 14, the third column labeled "Pixel Electrode (ΔV)" shows a difference between the voltages applied to the pixel electrodes of a pair of pixel units.

Referring to FIGS. 3, 12, 13, and 14, when the first and second transistors ST1 and ST2 have the same channel width of, for example, about 30 μm, the difference between the overlapping length l1 of the first gate electrode 220 and the first source electrode 260 of the first transistor ST1 and the overlapping length l2 of the second gate electrode 220' and the second source electrode 260' of the second transistor ST2 may be about 35 μm to about 60 μm. Thus, the difference between the overlapping length l1 of the first gate electrode 220 and the first source electrode 260 of the first transistor ST1 and the overlapping length l2 of the second gate electrode 220' and the second source electrode 260' of the second transistor ST2 may be about one to two times the channel width of the first and second transistors ST1 and ST2. Accordingly, the display device according to the exemplary embodiment of FIG. 1 may generate a voltage difference of 2V to 3V between pixel electrodes PE1 and PE2 of first and second pixel units PX11 and PX21. In one embodiment, the first and second source electrodes may have the same width.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the invention as set forth in the following claims.

What is claimed is:

1. A display device, comprising:

a data driver connected to j- to (j+2)-th data lines;

a scan driver connected to i- to (i+3)-th scan lines; and a display panel including k- and (k+1)-th pixel groups, wherein:

the k-th pixel group includes:

an i-th transistor having a gate electrode connected to the i-th scan line, a first electrode connected to the j-th data line, and a second electrode connected to an i-th pixel electrode, and an (i+1)-th transistor having a gate electrode connected to the (i+1)-th scan line, a first electrode connected to the j-th data line, and a second electrode connected to an (i+1)-th pixel electrode, the (k+1)-th pixel group includes:

an (i+2)-th transistor having a gate electrode connected to the (i+2)-th scan line, a first electrode connected to the (j+1)-th data line, and a second electrode connected to an (i+2)-th pixel electrode, and an (i+3)-th transistor having a gate electrode connected to the (i+3)-th scan line, a first electrode connected to the (j+1)-th data line, and a second electrode connected to an (i+3)-th pixel electrode, the i- and (i+1)-th transistors are to be turned on at a same time, a kickback voltage of the i-th transistor is less than a kickback voltage of the (i+1)-th transistor, the (i+2)- and (i+3)-th transistors are to be turned on at the same time, and a kickback voltage of the (i+2)-th transistor is less than a kickback voltage of the (i+3)-th transistor.

2. The display device as claimed in claim 1, wherein:

an overlapping area of the gate electrode and the second electrode of the i-th transistor is less than an overlapping area of the gate electrode and the second electrode of the (i+1)-th transistor, and an overlapping area of the gate electrode and the second electrode of the (i+2)-th transistor is less than an overlapping area of the gate electrode and the second electrode of the (i+3)-th transistor.

3. The display device as claimed in claim 1, wherein:

j- and (j+1)-th data signals applied to the j- and (j+1)-th data lines, respectively, swing between a signal with positive polarity and having a greater level than a common voltage and a signal with negative polarity and having a lower level than a common voltage, and have opposite phases.

4. The display device as claimed in claim 3, wherein:

when a j-th data signal with positive polarity is applied to the j-th data line and a (j+1)-th data signal with negative polarity is applied to the (j+1)-th data line, a voltage applied to the i-th pixel electrode is greater than a voltage applied to the (i+1)-th pixel electrode, and a voltage applied to the (i+2)-th pixel electrode is greater than a voltage applied to the (i+3)-th pixel electrode, and when a j-th data signal with negative polarity is applied to the j-th data line and a (j+1)-th data signal with positive polarity being applied to the (j+1)-th data line, a voltage applied to the i-th pixel electrode is less than a voltage applied to the (i+1)-th pixel electrode, and a voltage applied to the (i+2)-th pixel electrode is less than a voltage applied to the (i+3)-th pixel electrode.

5. The display device as claimed in claim 3, wherein:

the k-th pixel group includes:

an (i+4)-th transistor having a gate electrode connected to the i-th scan line, a first electrode connected to the (j+1)-th data line, and a second electrode connected to an (i+4)-th pixel electrode, and an (i+5)-th transistor having a gate electrode connected to the (i+1)-th scan line, a first electrode connected to the (j+1)-th data line, and a second electrode connected to an (i+5)-th pixel electrode, and the (k+1)-th pixel group includes:

an (i+6)-th transistor having a gate electrode connected to the (i+2)-th scan line, a first electrode connected to the (j+2)-th data line, and a second electrode connected to an (i+6)-th pixel electrode, and an (i+7)-th transistor having a gate electrode connected to the (i+3)-th scan line, a first electrode connected to the (j+2)-th data line, and a second electrode connected to an (i+7)-th pixel electrode.

6. The display device as claimed in claim 5, wherein:

a kickback voltage of the (i+4)-th transistor is less than a kickback voltage of the (i+5)-th transistor, and a kickback voltage of the (i+6)-th transistor is greater than a kickback voltage of the (i+7)-th transistor.

7. A display device, comprising:

first and second scan lines extending on a substrate in a first direction and connected to a scan driver;

a first data line on the substrate along a second direction intersecting the first direction and insulated from the first and second scan lines;

a first pixel unit including a first transistor having a gate electrode connected to the first scan line, a first electrode connected to the first data line, and a second electrode connected to a first pixel electrode; and a second pixel unit including a second transistor having a gate electrode connected to the second scan line, a first electrode connected to the first data line, and a second electrode connected to a second pixel electrode, wherein an overlapping area of the gate electrode and the second electrode of the second transistor is greater than an overlapping area of the gate electrode and the second electrode of the first transistor.

8. The display device as claimed in claim 7, wherein an overlapping length of the gate electrode and the second electrode of the second transistor is about 35 μm to about 60 μm longer than an overlapping length of the gate electrode and the second electrode of the first transistor.

9. The display device as claimed in claim 7, wherein the first and second transistors are to be turned on at a same time.

10. The display device as claimed in claim 7, further comprising:

a second data line on the substrate along the second direction;

a third pixel unit including a third transistor having a gate electrode connected to the first scan line, a first electrode connected to the second data line, and a second electrode connected to a third pixel electrode; and a fourth pixel unit including a fourth transistor having a gate electrode connected to the second scan line, a first electrode connected to the second data line, and a second electrode connected to a fourth pixel electrode, wherein an overlapping area of the gate electrode and the second electrode of the fourth transistor is greater than an overlapping area of the gate electrode and the second electrode of the third transistor.

11. The display device as claimed in claim 10, wherein first and second data signals applied to the first and second data lines, respectively, swing between a signal with positive polarity and having a higher level than a common voltage and a signal with negative polarity and having a lower level than a common voltage, and have opposite phases.

12. The display device as claimed in claim 7, further comprising:

third and fourth scan lines on the substrate along the first direction;

a second data line on the substrate along the second direction;

a third pixel unit including a third transistor having a gate electrode connected to the third scan line, a first electrode connected to the second data line, and a second electrode connected to a third pixel electrode; and a fourth pixel unit including a fourth transistor having a gate electrode connected to the fourth scan line, a first electrode connected to the second data line, and a second electrode connected to a fourth pixel electrode, wherein an overlapping area of the gate electrode and the second electrode of the third transistor is greater than an overlapping area of the gate electrode and the second electrode of the fourth transistor.

13. A display device, comprising:

a data driver connected to j- and (j+1)-th data lines;

a scan driver connected to i- and (i+1)-th scan lines; and a display panel including k- and (k+1)-th pixel units, wherein:

the k-th pixel unit includes an i-th transistor with a gate electrode connected to the i-th scan line, a first electrode connected to the j-th data line, and a second electrode connected to an i-th pixel electrode, the (k+1)-th pixel unit includes an (i+1)-th transistor having a gate electrode connected to the (i+1)-th scan line, a first electrode connected to the j-th data line, and a second electrode connected to an (i+1)-th pixel electrode, the i- and (i+1)-th transistors are to be turned on at a same time, and a kickback voltage of the i-th transistor is less than a kickback voltage of the (i+1)-th transistor.

14. The display device as claimed in claim 13, wherein an overlapping area of the gate electrode and the second electrode of the i-th transistor is less than an overlapping area of the gate electrode and the second electrode of the (i+1)-th transistor.

15. The display device as claimed in claim 13, wherein a j-th data signal to be applied to the j-th data line swings between a signal with positive polarity and having a higher level than a common voltage and a signal with negative polarity and having a lower level than a common voltage.

16. The display device as claimed in claim 15, wherein:

when a j-th data signal with positive polarity is applied to the j-th data line, a voltage applied to the i-th pixel electrode is higher than a voltage applied to the (i+1)-th pixel electrode, and when a j-th data signal with negative polarity is applied to the j-th data line, a voltage applied to the i-th pixel electrode is less than a voltage applied to the (i+1)-th pixel electrode.

17. The display device as claimed in claim 13, wherein j- and (j+1)-th data signals applied to the j- and (j+1)-th data lines, respectively, swing between a voltage with positive polarity and a voltage with negative polarity relative to a common voltage and have opposite phases.

18. The display device as claimed in claim 17, wherein the display panel further includes:

(k+2)- and (k+3)-th pixel units, the (k+2)-th pixel unit including an (i+2)-th transistor having a gate electrode connected to the i-th scan line, a first electrode connected to the (j+1)-th data line, and a second electrode connected to an (i+2)-th pixel electrode, the (k+3)-th pixel unit includes an (i+3)-th transistor having a gate electrode connected to the (i+1)-th scan line, a first electrode connected to the (j+1)-th data line, and a second electrode connected to an (i+3)-th pixel electrode, and when a (j+1)-th data signal is applied to the first electrode of the (i+2)-th transistor from the (j+1)-th data line having a same level as a (j+1)-th data signal applied to the first electrode of the (i+3)-th transistor from the (j+1)-th data line, a kickback voltage of the (i+2)-th transistor is less than a kickback voltage of the (i+3)-th transistor.

19. The display device as claimed in claim 18, wherein:

when a j-th data signal with positive polarity is applied to the j-th data line and a (j+1)-th data signal with negative polarity is applied to the (j+1)-th data line, a voltage applied to the i-th pixel electrode is greater than a voltage applied to the (i+1)-th pixel electrode, and a voltage applied to the (i+3)-th pixel electrode is greater than a voltage applied to the (i+2)-th pixel electrode.

20. The display device as claimed in claim 18, wherein:

when a j-th data signal with negative polarity is applied to the j-th data line and a (j+1)-th data signal with positive polarity is applied to the (j+1)-th data line, a voltage applied to the i-th pixel electrode is less than a voltage applied to the (i+1)-th pixel electrode, and a voltage applied to the (i+3)-th pixel electrode is less than a voltage applied to the (i+2)-th pixel electrode.

* * * * *